US010023453B2

(12) United States Patent
Leibinger

(10) Patent No.: US 10,023,453 B2
(45) Date of Patent: Jul. 17, 2018

(54) DEVICE AND METHOD FOR FILLING A CONTAINER WITHOUT USING MEASURING MEANS

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 0 days.

(21) Appl. No.: 15/515,649

(22) PCT Filed: Sep. 29, 2015

(86) PCT No.: PCT/EP2015/001922
§ 371 (c)(1),
(2) Date: Mar. 30, 2017

(87) PCT Pub. No.: WO2016/050350
PCT Pub. Date: Apr. 7, 2016

(65) Prior Publication Data

US 2017/0297883 A1 Oct. 19, 2017

(30) Foreign Application Priority Data

Oct. 1, 2014 (DE) ..... 10 2014 014 317

(51) Int. Cl.
*B65B 39/00* (2006.01)
*B67C 3/10* (2006.01)
(Continued)

(52) U.S. Cl.
CPC ..... *B67C 3/10* (2013.01); *B67C 3/2614* (2013.01); *B67C 9/00* (2013.01); *B67C 2003/2688* (2013.01)

(58) Field of Classification Search
CPC ..... B67C 3/10; B67C 9/00; B67C 3/2614; B67C 2003/2688
See application file for complete search history.

(56) References Cited

U.S. PATENT DOCUMENTS 3,335,767 A 8/1967 Manas
5,295,517 A 3/1994 Ahlers
(Continued)

FOREIGN PATENT DOCUMENTS

DE 40 38 890 6/1991
DE 10 2011 100 560 3/2012
(Continued)

*Primary Examiner* — Jason K Niesz
(74) *Attorney, Agent, or Firm* — Gudrun E. Huckett

(57) ABSTRACT

The present invention relates to a method for filling a fluid into a container without using measuring means and to a filling apparatus therefor which comprises an attachment having a predetermined volume $V_A$, said attachment comprising a valve attachment which has a gas valve and a liquid valve with a valve seat in a housing. Said valve seat surrounds a displacement element that can be moved along the longitudinal axis relative to the housing, and forms an annular gap. According to said method, the attachment is tightly placed onto a container (1) while the displacement element is inserted into the container (1). When the liquid valve (5) is opened, the filling fluid flows into the nominal volume $V_N$ of the container (1), and said nominal volume is flooded with the filling fluid; the liquid valve is then closed. The displacement element is withdrawn from the container (1) and the flooded remaining volumes top up the contents in the container (1), the volumina $V_{VA}$ and $V_{FV}$ equaling the volume $V_{Rohr}$ of a portion of the displacement element in the flooded portion so that identical containers (1) are filled with identical fill levels.

13 Claims, 2 Drawing Sheets

(51) Int. Cl.

| | |
|---|---|
| ***B67C 9/00*** | (2006.01) |
| ***B67C 3/26*** | (2006.01) |

(56) References Cited

U.S. PATENT DOCUMENTS

| | | | |
|---|---|---|---|
| 2014/0047797 | A1 | 2/2014 | Leibinger |
| 2015/0284232 | A1 | 10/2015 | Leibinger |
| 2016/0145089 | A1 | 5/2016 | Leibinger |

FOREIGN PATENT DOCUMENTS

| | | |
|---|---|---|
| DE | 10 2012 021 775 | 8/2014 |
| DE | 10 2014 008 234 | 12/2014 |
| EP | 0 536 505 | 4/1993 |
| WO | 2014/071903 | 5/2014 |

DEVICE AND METHOD FOR FILLING A CONTAINER WITHOUT USING MEASURING MEANS

BACKGROUND OF THE INVENTION

The invention relates to a filling apparatus working without any measuring devices as well as to a method for filling a container with fluid using the filling apparatus but without using any measuring devices.

There are known filling apparatuses and methods for filling containers in many embodiments. Where liquids, such as wine or chemicals, are concerned, it is often necessary to prevent the liquid from being exposed to ambient air and to avoid any undesired gas absorption, gas transfer or gas entry, which might result in a change in quality of the liquid.

There are known prior art methods in this regard, such as that disclosed in DE 10 2011 1005 60 B3 , which describes an apparatus that serves to apply the method and is intended to efficiently fill a container without any gas contact, the container containing a liquid intended for consumption. Therein, application of the method provides that at least one balloon-type expandable body is inserted into the container, said body being, arranged on a pipe and enclosing this pipe. After having been inserted into the container, this balloon-type body is expanded, thus entirely filling the interior region of the container and displacing ambient air out of the container. Thereafter, liquid is caused to flow into the container while, at the same time, the expansion medium is displaced through the pipe and out of the balloon-type body. After the container has been filled completely, the balloon-type body is removed from the container and provided for the next filling operation.

In order to be able to always fill the same filling volume into the containers, methods such as the aforementioned one provide that, to fill the container with a desired filling volume or nominal volume, the liquid is predosed in a sensor-controlled manner using a control unit which usually is a magnetic-inductive flow meter or is filled into the respective container using a piston system.

For production-related reasons, containers such as bottles can be provided for receiving identical quantities but may, therein, have bottoms or walls with varying thickness, so that the actual filling capacity varies to a minor degree; in case of glass bottles having the usual filling capacities, such as for wine, etc., this variation may reach up to 10 ml, so that the volume that is always correctly dosed by means of a magnetic-inductive flow meter results in different filling levels which will be visually noticeable especially in the vicinity of the neck of the bottle—thus affecting, for example, the consumers' behaviour.

Based on this prior art, it is an object of the invention to create a method for filling containers which allows reaching a constant filling level even with different container shapes.

SUMMARY OF THE INVENTION

This problem is solved by means of a method for filling a container without any measuring devices, using a filling apparatus comprising an attachment having a predetermined volume, wherein the attachment has a valve attachment which has a gas valve and a fluid valve with a valve seat in a housing, wherein the valve seat surrounds a displacement element that is movable along a longitudinal axis in relation to the housing while forming an annular gap, comprising the steps of:

a) tightly placing the attachment with its bottom side onto a container while inserting the displacement element into the container, b) opening the fluid valve and letting filling fluid flow into a nominal volume $V_{nom}$ of the container, which is formed by the volume $V_A$ of the attachment and a volume $V_C$ of the container, until the nominal volume $V_{nom}$ is flooded with filling fluid, then closing the fluid valve, and c) pulling the displacement element out of the container and letting the volume $V_A$ flow into the container, wherein the volume $V_A$ is equal to the volume $V_{balloon}$ of a section of the displacement element in the flooded section, with the result that the same containers are filled up to the same filling levels.

The further object of providing a simple and reliable filling apparatus for applying this method is reached by the filling apparatus for applying the method of the invention without any measuring devices, comprising an attachment having a predetermined volume $V_A$, wherein said attachment can be tightly placed onto the container and has a valve attachment, which has a housing as well as a gas valve and a fluid valve each of which have a valve seat and wherein the valve seats surround a displacement element while forming an annular gap, said displacement element being movable along a longitudinal axis in relation to the housing, and wherein a fluid supply line is connected to the fluid valve, wherein the filling apparatus in the fluid supply line does not have any volume measuring device and does not have any filling level measuring device.

Preferred embodiments of the method and the filling apparatus are presented in the dependent claims.

According to a first embodiment, the method according to the invention for filling a container with a fluid without any measuring devices is performed with a filling apparatus comprising an attachment having a predefined volume $V_A$. Therein, the attachment has a valve attachment which has a gas valve and a fluid valve with a valve seat in a housing. While forming an annular gap, the valve seat surrounds a displacement element which can be moved along a longitudinal axis in relation to the housing.

According to the invention, the method comprises the following steps:

a) tightly placing the attachment with its bottom onto a container while inserting the displacement element into the container, b) opening the fluid valve and letting filling fluid flow into a nominal volume $V_{nom}$ of the container, which is formed by the volume $V_A$ of the attachment and a volume $V_C$ of the container, until the nominal volume $V_{nom}$ is flooded with filling fluid, then closing the fluid valve.

In general, the volume $V_{FV}$ of the fluid valve is even flooded as well but this volume is pressed out of the fluid valve after the fluid valve has been closed and, since it does not flow on, therefore does not have to be taken into account when handling the valve in the generally known manner. If this volume remains in the attachment due to the design and handling of the valve and fails to be pressed back to the fluid source when the valve is closed, it can flow on and must be taken into account arithmetically. This is followed by step c) which comprises pulling the displacement element out of the container and letting the volume $V_{VA}$ (and, in special cases only, volume $V_{FV}$) to flow on into the container, wherein the volume $V_{VA}$ or, in special cases, volumes $V_{VA}$ and $V_{FV}$ is/are equal to the volume $V_{balloon}$ of a section of the displacement element in the flooded section, with the result that same containers are filled up to the same filling levels.

Thereafter, the container can be decoupled from the attachment and be closed. The method can be repeated from the beginning.

This means that the method is applied without any measuring devices which, in the sense of the invention, means that a desired fluid quantity is only provided by forming defined volumes of individual components which, together, form the nominal volume $V_{nom}$, as is illustrated in more detail below. Therein, this nominal volume $V_{nom}$, corresponds to the volume to be filled into the respective container until a predefined nominal level is reached.

Herein, "same containers" is understood to mean vessels which, apart from production-related differences in their wall and bottom thickness, are identical.

A refinement of the invention can comprise step a') according to which the displacement element is inserted and subsequently a balloon-type body which is put over a pipe can be expanded by supplying an expansion medium until the container to be filled and, more particularly, the nominal volume $V_{nom}$, are lined.

Herein, "until the container to be filled is lined" is understood to mean that the balloon-type body lines the volumes mentioned in such a manner that a gap remaining between the internal wall and the surface of the balloon-type body allows fluid to flow or air to be displaced along the balloon-type body while the latter is expanded prior to filling even if this body comes to lie against the wall while it is expanding. Gas inclusions in the container are thus prevented. It is, however, not necessary in any case to have a gap remaining between the balloon and the container wall.

"Fluids" can be liquids such as drinks or chemicals; "expansion media" can be gases such as air or inert gases or liquids that are suitable to fill the respective balloon-type body.

In a further step b'), the balloon-type body can furthermore be allowed to collapse; this can be achieved by relieving a vacuum that has been applied to the container and has drawn the balloon to the internal wall or by letting the expansion medium escape from the balloon-type body; therein, the fluid is allowed to continue to flow into the container.

Based on these two additional steps, the method allows sensitive fluids to be filled in because, by inflating the balloon-type body or the balloon, the air present in the container can be pressed out and the filling fluid therefore comes into contact with air to a minor extent only. Furthermore, the balloon can also cause other fluids, such as residual water from a rinsing operation or the like, to be removed from the container before the actual filling fluid is filled in.

Patent applications DE 10 2014 008 234 and DE 10 2012 021 775 A1 are explicitly included and their content referenced herein; these applications disclose filling apparatuses which are filled and emptied utilizing the balloon-stick principle.

In step b), the fluid valve closes after the fluid that is being filled in has completely filled the container and the valve as well (passive control). Alternatively, the fluid can also trigger a valve mechanism when active control is provided. To achieve this, the fluid valve can be a pressure valve. To prevent too much fluid from being filled in or excessive pressure building up inside the filling apparatus, it can furthermore be provided that, in step b'), the fluid valve is closed when a predetermined pressure is reached in the filling fluid circuit. To achieve this, a pressure sensor system can be installed in a suitable section of the fluid valve or a fluid supply line. For this purpose, it is also possible to have a passive component, such as a pressure relief valve, connected to a liquid supply line.

The embodiment according to the invention allows achieving a constant nominal level $I_{nom}$ by varying or adjusting a nominal volume $V_{nom}$ in a container-specific manner. A nominal level to be reached in each container corresponds to a nominal volume $V_{nom}$ which is specific for each container shape.

Essentially, the nominal volume is determined from the nominal level $I_{nom}$ up to which the container is to be filled. To maintain the nominal level $I_{nom}$, it is important for each filling operation that the displacement element should protrude into the container for a specific length $h_{balloon}$ and accordingly displace the volume thus formed. This means that, to reach the nominal volume, the volume displaced by the displacement element is refilled in the container. This can be achieved by means of the invention by this volume being reflected in the components of the attachment. In short: The displacement volume of the displacement element in the container corresponds to the volumes remaining in the attachment minus the displacement element.

Therein, the empty volumes are composed of various volumes of the components of the filling apparatus.

As a result, a volume $V_C$ of the container is included in the nominal volume $V_{nom}$ to be reached. Furthermore, a through-hole and various recesses in the attachment allow forming a volume $V_A$ of the attachment. A volume $V_{FV}$ can also be formed inside the fluid valve. Along with the balloon-type body in its non-expanded form, the displacement element takes up a volume $V_{balloon}$ in the container and the remaining components of the filling system, wherein this volume should not be included in the aforementioned volumes but be subtracted as displacement volume. If the balloon-type body has thick walls, its displacement volume is accordingly larger than with a thin-wall material. This results in the following equation:

$$V_{nom}=V_C+V_A-V_{balloon},$$

In the special case mentioned above, if due to the design of the valve attachment the liquid is not pressed back into the fluid source when the valve is closed, the following equation applies:

$$V_{nom}=V_C+V_A+V_{FV}-V_{balloon}$$

Therein, the total volume of the various attachment components exclusive of the container volume corresponds to the total volume in the filling, apparatus that is displaced by the pipe with the balloon-type body. In other words, the volume that is displaced in the container by the displacement element including the balloon-type body has the same size as the residual volumes formed by the attachment components without displacement element. When the displacement element and, therefore, also the balloon-type body where applicable is pulled out, precisely this residual volume can slide on and fill the container.

Furthermore, the mentioned volumes inside the attachment can be adjusted in a container-specific manner by providing compensation volumes in the valve attachment or in other suitable regions of the filling apparatus. For example, a plurality of volume compensating elements or only one volume compensating element can be attached in the filling or fluid valve below or above the same. The nominal volume can therefore be adjusted to any container shape, thus allowing different container shapes having the same filling volume to be filled with the required nominal volume such that the same filling height is always reached in the different containers.

In order to use a further volume compensation element in the method in a container-specific and simple manner, it can be provided that the attachment further comprises a volume compensator which is in fluid connection with the valve attachment wherein, in step a), the volume compensator can be tightly placed with its bottom side onto the empty or full container. In general, the volume compensator can also be arranged above the valve attachment. In principle, the volume compensator above the filling valve has the same design as that below the filling valve. In this case, it is arranged as an "intermediate piece" between the balloon receptacle and the filling valve. In this case, the balloon receptacle is still the topmost point and holds the balloon concentrically in the volume compensator and the filling valve. As a result, the balloon still displaces the entire air from the volume compensator while the filling principle is obtained in the same manner as in the version in which the volume compensator is directly seated on the vessel.

Therein, the interior region of the volume compensator forms a predetermined volume VCP which can be explicitly defined in one embodiment. Thereby, the volume of the attachment VA can be composed of the volume formed by the valve attachment VVA and the volume VCP of the volume compensator:

$$V_A = V_{VA} + V_{CP}$$

In a further embodiment, the volume of the volume compensator can be adjusted to various container sizes by means of suitable volume alteration devices and therefore be variable. Herein, "variable" is not only understood to mean that the various cavities in the filling apparatus form a fixed invariable volume and therefore restrict the filling to one option only but also that the respective volumes can be adjusted to the containers to be filled or to the displacement element immersion depth. To achieve this, the volume compensator can consist of multiple parts, more particularly of two parts, and form different volume sizes depending on the joined elements.

The active volume of the respective compensation element can also be variable if it is intended to retrofit the apparatus for the purpose of filling different containers. For example, variable displacement can be achieved using apparatuses with slides, a guide pulley or a variable/different wall thickness, the contour of a stopper or an adjusted shape of the balloon-type body. As a result, $CO_2$-containing liquids can also be filled in, without any "gushing" (expansion due to sudden pressure release) developing.

It is therefore possible to reach a constant filling level, i.e., a specific filling volume per container, for different containers by forming specific volumes inside the attachment. In this manner, the volume compensator is a means to adjust the volume to be filled in to the container to be filled. It is also possible to provide further compensation volumes inside the valve attachment, wherein said compensation volumes can, for example, be formed by recesses or grooves in a through-hole of the valve attachment.

In a further embodiment, the invention provides that, in step a'), the expanding balloon-type body has a longitudinal web along its perimeter. This longitudinal web extends in the longitudinal direction of the balloon-type body, with the result that, in the expanded state of the balloon-type body, a gap is formed along the length of the balloon between the surface of the balloon-type body and an inner surface of the attachment. With regard to the number of its webs, the balloon-type body can also have clearly more webs than the at least one web required for accomplishment, so that less liquid is allowed to flow into the bottle or the displacement of the air or liquid present in the container is increased. It is also possible to provide grooves or other devices for this purpose. As regards the potential embodiments of this body, reference is made to DE 10 2014 008 234.

The contribution of the balloon-type body to the volume $V_{balloon}$ is essentially given by its wall thickness. Depending on the type of container to be filled or on the size of the volume to be filled in, the balloon-type body can have a wall thickness ranging from a few micrometers to several millimeters.

One embodiment of a filling apparatus according to the invention for applying the aforementioned method without any measuring devices to achieve the same filling level in same containers has the following components:

The filling apparatus has an attachment with a predetermined volume $V_A$, the attachment sitting tightly on the container and comprising a valve attachment. The valve attachment itself has a gas valve and a fluid valve in a housing, each of these valves having a valve seat. The valve seats surround a displacement element while forming an annular gap, wherein the displacement element can be moved along a longitudinal axis in relation to the housing. Furthermore, a fluid supply line which can be filled with a fluid to be filled in is connected to the fluid valve. According to the invention, the filling apparatus in the fluid feed line does not have any volume measuring device and does not have any filling level measuring device.

As a result, the aforementioned filling apparatus does not have any measuring devices which, in the sense of the invention, means that fluid can only be dosed by providing defined volumes of individual components which, together, form the nominal volume $V_{nom}$, as has already been illustrated above. Therein, this nominal volume $V_{nom}$ corresponds to the volume to be filled into the respective container until a predefined nominal level is reached.

According to the invention, it can furthermore be provided that the attachment has a volume compensator with a predetermined volume $V_{VC}$, said volume compensator being in fluid connection with the valve attachment and being placeable onto the container in a fluid-tight manner. The volume compensator can serve as a volume compensation element the inner volume of which can be fixed or variable.

The displacement element may have embodiments of varying suitability. In an embodiment according to the invention of the apparatus for filling a container with a liquid, it is provided that the displacement element can be a pipe having a balloon-type body, wherein the balloon-type body can partially or completely enclose the pipe. However, the principle according to the invention generally also functions without balloon, with the result that it can, for example, also be provided that the displacement element is a simple pipe. As a result, the liquid does not have to be removed from or filled into the container directly by means of a valve but can be handled in an improved manner according to the following embodiment according to the invention: To achieve this, the pipe can be arranged at a retaining section of the valve attachment or, while being positioned concentrically, can extend through an opening of the retaining section and further through the openings of the valve seats. According to one arrangement of use, the pipe can protrude to near a bottom of a given container, with the result that neither the bottom nor the balloon-type body is damaged. The balloon-type body is drawn over the free end of the pipe with its closed end and extends through the valve attachment all the way into the retaining section in which it is located.

In one embodiment, the balloon-type body is mounted in the opening of the retaining section in a fluid-tight manner and by means of a clamping body which, preferably, is supported against the upper section of the retaining section via a spring. Due to this arrangement, the balloon-type body securely sits on the pipe even if pressure is applied to the balloon and lets it expand or unfold. The pipe can extend upwardly through a drill hole and be received in a mounting adapter in a non-detachable manner, wherein said mounting adapter can be coupled to a fluid source, for example, a gas source.

A further embodiment of the invention may provide that the gas valve and the fluid valve comprise an annular closing part in addition to the valve seat, wherein the valve seat and the closing part are movable in relation to each other and are arranged coaxially to each other. In order to ensure that the valve attachment and/or the volume compensator can be placed onto the container in a fluid-tight manner, a seal can be provided at the container-sided opening of the respective component to be sealed.

Further embodiments as well as some of the advantages associated with these and other embodiments are revealed and more easily understandable by means of the following detailed description with reference being made to the accompanying figures. The figures are only a schematic representation of embodiments of the invention.

BRIEF DESCRIPTION OF THE DRAWINGS

In the figures.

DESCRIPTION OF PREFERRED EMBODIMENTS

Figure 1:
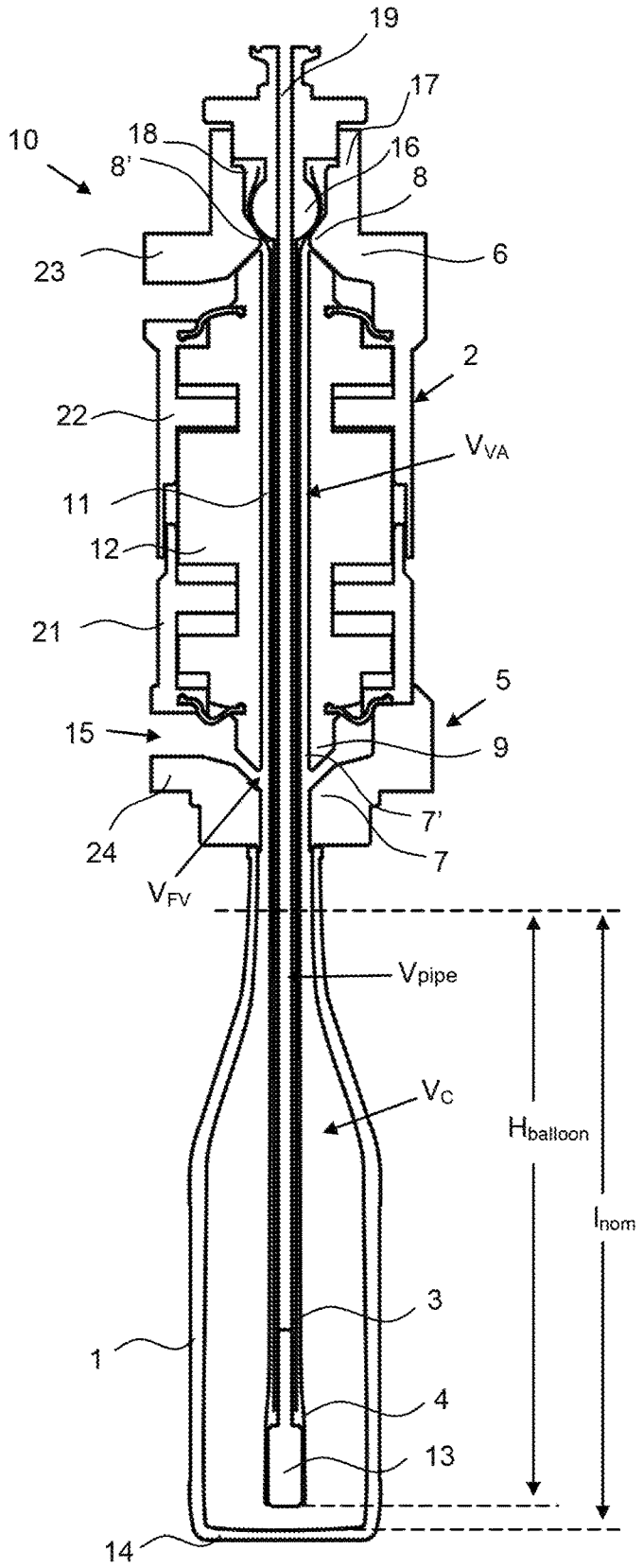
FIG. 1 is a longitudinal sectional view of a filling apparatus according to the invention.

In the illustrated instance, the filling apparatus 10 according to the invention shown in FIG. 1 is used for filling a bottle 1 but can, generally, also be used for any other container.

Therein, the filling apparatus 10 has an attachment which comprises a valve attachment 2. In the illustrated instance, a pipe 3 serving as a displacement element is passed through the valve attachment 2, with a balloon 4 being put over said pipe 3. Therein, the balloon 4 is designed such that, when it is in an expanded state, a gap remains between the surface of the balloon 4 and an internal wall of the valve attachment 2. In FIG. 1, the balloon 4 is shown in its non-expanded state.

Therein, the pipe 3 protrudes from the valve attachment 2 at its bottom side. The valve attachment 2 is designed such that it sits tightly on the bottle 1 with its bottom side (see FIG. 1).

Figure 2:
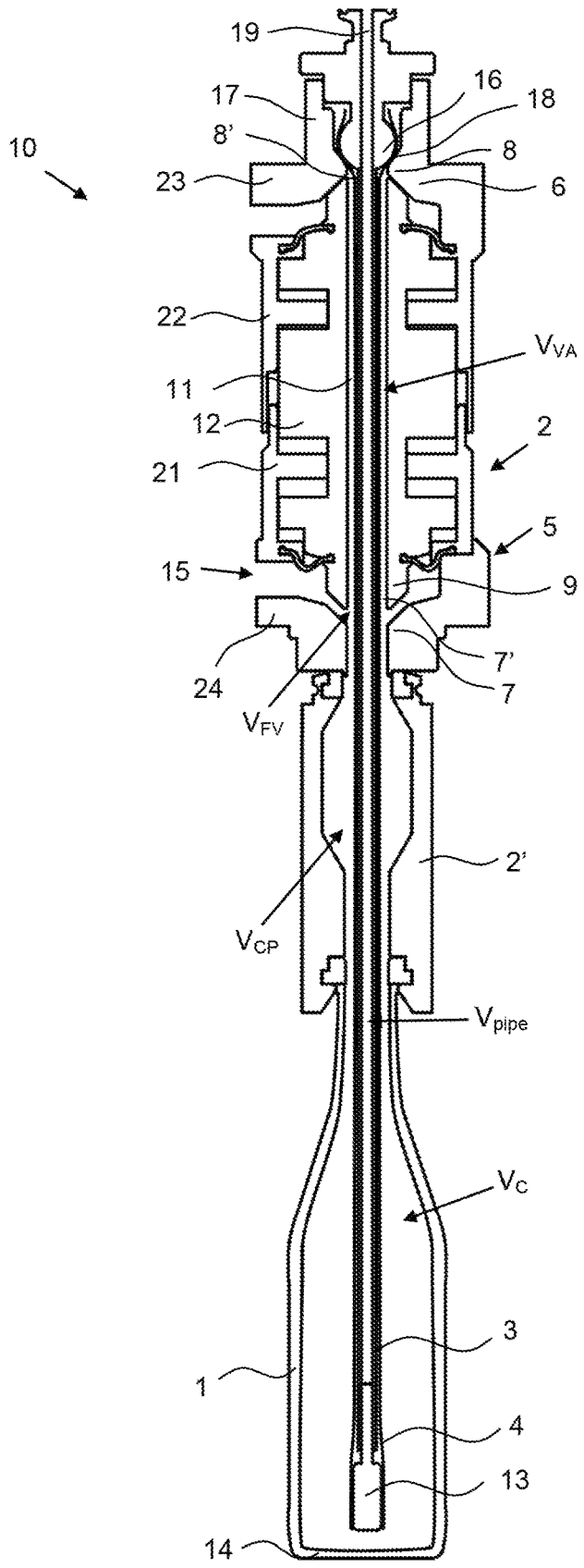
FIG. 2 is a longitudinal sectional view of an alternative filling apparatus having a volume compensator.

FIG. 2 shows that a volume compensator 2' is placed onto the bottle 1 between the bottle 1 and the valve attachment 2. This is above all used to allow compensating different volumes in different container types. FIGS. 1 and 2 each show a method step in which the container 1 has just been connected to the valve attachment 2 in a fluid-tight manner and the balloon 4 is shortly before being expanded.

The balloon 4 is connected to the pipe 3 in an upper end region thereof in a fluid-tight manner. There, a ball 16 is pushed onto the pipe 3 wherein the balloon 4 is drawn over this ball 16. The ball 16 sits in an opening 18 of a retaining section 17, wherein the balloon 4 is clamped in between the ball 16 and the upper edge of this opening 18. A through-hole 19 through which the expansion medium flows through the pipe 3 and into the balloon 4 extends through the ball 16.

The balloon-type body 4 can be a tube formed from a thermoplastic elastomer material, said tube being closed at its lower end, i.e., the end that is provided for positioning in the container 1 to be filled or emptied. It thus forms some kind of expanding body which can be inflated by means of an expansion medium, for example, air. In its non-expanded form, the tube has an inside diameter which corresponds to the outside diameter of the pipe 3 to displace a volume that is as small as possible. With regard to wall thickness and elasticity, the material composition is selected such that the tube that is expanded by being inflated takes the form of a balloon which fills the internal volume of the container 1 to be filled or, rather, the interior region of the upstream components, more particularly of the volume compensator 2' and the valve attachment 2.

Once the balloon 4 is in its expanded state, it lines not only the container 1 but also the interior region of the valve attachment 2, i.e., it comes to lie against a through-hole 11 and the valve seats 7, 8 from inside. Thereby, the valve attachment 2 can also be completely cleared from any ambient air prior to filling or, in case of refilling, from any fluid that has already been filled in, with the result that, here as well, the filling fluid is prevented from coming into contact with ambient air.

The valve attachment 2 has a fluid valve 5 and a gas valve 6 each having an annular valve seat 7, 8 and annular closing parts corresponding thereto. The valve seat 7 is designed stationary with regard to a container 1 to be filled, wherein the valve seat 8 is designed movable with regard to a longitudinal axis of the valve. The two closing parts are aligned with each other and surround the pipe 3, each forming an annular gap 7', 8'. The closing parts of the two valves 5, 6 are arranged in a common carrier 12 that is movable along the longitudinal axis of the valve. The valve attachment 2 can consist of several parts and, to achieve this, can be divided into different units. Therein, the units are surrounded by the housing parts 21, 22, 23, 24. Therein, the different units can be moved in relation to each other in the housing parts 21, 22, 23, 24 along the longitudinal axis of the valve to open individual ones or both of the valves 5, 6. Furthermore, a liquid supply line 15 (only schematically shown in the figures) is connected to the valve attachment 2.

A stopper 13 which serves to protect the sensitive bottom 14 of the container 1 and to prevent the free end of the pipe 3 from bouncing against this bottom 14 is provided at the free end of the pipe 3 which is, however, still surrounded by the balloon-type body 4. The stopper 13 is made of a flexible material, for example, rubber.

The volume compensator 2' shown in FIG. 2 is a body which has an essentially cylindrical design and a predefined volume $V_{VC}$ in its interior region. This volume serves to receive part of a defined filling volume which displaces the pipe 3 required for filling, including the balloon-type body 4, from the container 1 that is actually to be filled. Accordingly, this fluid volume received in the volume compensator 2' can flow on after the pipe 3 has been pulled out.

Due to the different components, volumes of different sizes are now being formed.

The container 1 encloses a volume $V_C$. The inside hole 11 of the valve attachment 2 maps a volume $V_{VA}$. Furthermore, a volume $V_{VF}$ is formed by the fluid valve 5 and, if use is made of a volume compensator 2' such as it is shown in FIG. 2, this volume compensator 2' forms a volume $V_{VC}$. All of these volumes have to be summed up to obtain a total volume.

The volume $V_{balloon}$ that is formed by the pipe 3 including the balloon-type body 4 must be subtracted from the sum total of all other volumes, because this volume displaces fluid inside all components including the container. This, results in a nominal volume $V_{nom}=V_C+V_{VA}+V_{VC}+V_{FV}-V_{balloon}$ the volume size of which corresponds to that of the fluid actually to be filled in. Therein, the sum total of the volumes of the various attachment components corresponds to the total volume $V_{balloon}$ inside the filling apparatus that is displaced through the pipe 3. The nominal volume $V_{nom}$ is achieved by the nominal level $I_{nom}$ that has to be reached, as is shown by way of example in FIG. 1. The volume in the container 1 that is displaced by the balloon-type body 4 is determined by the length by $h_{balloon}$ by which the pipe 3 with the balloon-type body 4 protrudes into the container 1. Therein, the displacement volume of the components protruding into the container 1 corresponds to the residual volumes in the attachment minus the displacement element. As a result, there is always the same filling level in each container 1 with (minimally) varying filling volume.

The aforementioned method is therefore executed as follows, wherein the sequence is the same for each embodiment, whether with or without volume compensator 2':

A lower side of the attachment is placed onto the respective container 1 in a fluid-tight manner. Thereafter, the displacement element, i.e., the pipe 3 with the balloon-type body 4, is inserted, wherein it is inserted as far as necessary to ensure that the stopper 13 is prevented from touching or hitting a bottom of the container 1. Furthermore, the gas valve 6 is opened so that the expansion medium can enter into and expand the balloon-type body 4 whereby it removes a major part of the ambient air from the container 1. Therein, the balloon-type body 4 lies against the internal wall of the container 1 such that a gap providing a fluid or air path remains where there are webs along the length of said body.

Once the balloon-type body fills the internal volume that is filled by the individual cavities of the components, the fluid valve 5 is opened. Since there is the gap, fluid can enter into the same. In the meantime, the expansion medium is released from the balloon-type body 4 so that it collapses and lies against the pipe 3. The remaining volumes developing in the attachment, more particularly in the valve attachment 2 and the volume compensator 2' if any is used, are filled with fluid, with the result that the container 1 is filled except for the section of the pipe 3 along with the balloon-type body 4 that protrudes into the fluid. Therein, the volume the pipe 3 with the balloon-type body 4 being in its non-expanded state takes up inside the container 1 exactly corresponds to the volume that is formed by the aforementioned residual volumes in the attachments, the fluid valve 5, etc.

Once these volumes are flooded, the fluid valve 5 is closed and the pipe 3 is pulled out. Therein. the aforementioned fluid-filled volumes "slide on" and flow into the container 1. As a result, precisely the aforementioned section is now also being filled with fluid and a steady nominal volume $V_{nom}$ and therefore a steady nominal level $I_{nom}$ correlating with it can be achieved. The aforementioned statement, however, only relates to one and the same container, i.e., in the sense that the apparatus according to the invention allows achieving well repeatable filling accuracies. But especially according to the invention, an automatic adjustment without any measuring devices of different containers can be achieved, to that these containers are filled with different volumes in order to always obtain the same filling level.

LIST OF REFERENCE SYMBOLS

1 Container
2 Valve attachment
2' Volume compensator
3 Pipe
4 Balloon-type body; balloon
5 Fluid valve
6 Gas valve
7 Valve seat
7' Annular gap
8 Valve seat
8' Annular gap
10 Filling apparatus
11 Through-hole
12 Carrier
13 Stopper
14 Bottom
15 Fluid supply line
16 Ball
17 Retaining section
18 Opening
19 Through-hole
21 First housing part
22 Second housing part
23 Third housing part
24 Fourth housing part
$V_{nom}$ Nominal volume
$V_C$ Container volume
$V_{VA}$ Valve attachment volume
$V_{FV}$ Fluid valve volume
$V_{VC}$ Volume compensator volume
$V_{balloon}$ Volume in pipe including balloon-type body
$h_{balloon}$ Balloon height
$I_{nom}$ Nominal filling level

What is claimed is:

1. A method for filling a container (1) without any measuring devices, using a filling apparatus (10) comprising an attachment having a predetermined volume, wherein the attachment has a valve attachment (2) which has a gas valve (6) and a fluid valve (5) with a valve seat (7, 8) in a housing (21, 22, 23, 24), wherein the valve seat (7, 8) surrounds a displacement element that is movable along a longitudinal axis in relation to the housing while forming an annular gap (7', 8'), comprising the steps of:

a) tightly placing the attachment with its bottom side onto a container (1) while inserting the displacement element into the container (1), b) opening the fluid valve (5) and letting filling fluid flow into a nominal volume $V_{nom}$ of the container, which is formed by the volume $V_A$ of the attachment and a volume $V_C$ of the container, until the nominal volume $V_{nom}$ is flooded with filling fluid, then closing the fluid valve (5), and c) pulling the displacement element out of the container (1) and letting the volume $V_A$ flow into the container (1), wherein the volume $V_A$ is equal to the volume $V_{balloon}$ of a section of the displacement element in the flooded section, with the result that the same containers (1) are filled up to the same filling levels.

2. The method according to claim 1,
wherein
the attachment furthermore comprises a volume compensator (2') which is in fluid connection with the valve attachment (2),
wherein the attachment is tightly placed with the bottom side of the volume compensator onto the container (1) in step a).

3. The method according to claim 1, further comprising the step of:
a') after inserting the displacement element, allowing a balloon-type body (4) which is put over a pipe (3) to expand until the container (1) to be filled is lined, and expanding the balloon-type body (4) is achieved by supplying an expansion medium or by applying a vacuum to the container (1).

4. The method according to claim 3, further comprising the step of:
b') after opening the fluid valve (5), continuing to allow the filling fluid to flow in and the balloon-type body (4) to collapse.

5. The method according to claim 3,
wherein the expanding balloon-type body (4) has at least one longitudinal web along its perimeter, said web extending in the longitudinal direction of the balloon-type body (4) so that, in the expanded state of the balloon-type body (4), at least one fluid path is formed between the surface of the balloon-type body (4) and an internal surface of the attachment in step a).

6. The method according to claim 1, further comprising the step of:
b") closing the fluid valve (5) when a predetermined pressure is reached in the filling fluid circuit.

7. A filling apparatus (10) for applying the method according to claim 1, comprising an attachment having a predetermined volume $V_A$, wherein said attachment can be tightly placed onto the container (1) and has a valve attachment (2), which
has a housing (21, 22, 23, 24) as well as a
gas valve (6) and a fluid valve (5) each of which have a valve seat (7, 8) and
wherein the valve seats (7, 8) surround a displacement element while forming an annular gap (7', 8'), said displacement element being movable along a longitudinal axis in relation to the housing (21, 22, 23, 24),
wherein the displacement element is inserted into the container when the attachment is placed onto the container;
and wherein a fluid supply line is connected to the fluid valve (5), characterised in that the filling apparatus (10) in the fluid supply line does not have any volume measuring device and does not have any filling level measuring device.

8. The filling apparatus (10) according to claim 7, characterised in that
the attachment has a volume compensator (2') which has a predetermined volume VVC, is in fluid connection with the valve attachment (2) and can be placed onto the container (1) in a fluid-tight manner.

9. The filling apparatus (10) according to claim 7,
characterised in that
the displacement element is a pipe (3) with a balloon-type body (4) wherein the balloon-type body (4) at least partially encloses the pipe (3),
wherein the pipe (3) is arranged at a retaining section (17) of the valve attachment (2) and positions itself concentrically through a through-hole (19) of the retaining section (17) and extends further through the valve seats (7, 8) and their annular closing parts and, in use, is designed to protrude to near a bottom (14) of a given container (1) and
wherein the balloon-type body (4) is drawn over the free end of the pipe (3) with its closed end and extends through the valve attachment (2) all the way into the retaining section (17) and is located therein.

10. The filling apparatus (10) according to claim 7,
characterised in that
the balloon-type body (4)
is formed by a tube that is made of a thermoplastic elastomer material, preferably of a TPE extrudate, and is closed at one of its ends, wherein the closure of the tube is preferably formed by an end piece that is welded to the tube material and inserted into the tube end, more preferably by a cylindrical end piece, most preferably by a cylindrical PE end piece, and wherein the tube has at least one longitudinal web and/or at least one longitudinal groove, preferably two or more longitudinal webs or grooves along its length, or
is a body that is made of a non-elastomer material and is not open at its lower end, said body having at least one longitudinal web and/or at least one longitudinal groove, preferably two or more longitudinal webs or grooves along its length, and/or
has a tube-like section the inside diameter and length of which correspond to an outside diameter of a displacement element determined for use in the filling apparatus, with the result that the tube-like section can be drawn onto the displacement element without any play, and
has an unfoldable section having a shape which is designed to lie against an internal wall of the container (1) in an unfolded state.

11. The filling apparatus (10) according to claim 7,
characterised in that
the gas valve (6) and a fluid valve (5) comprise an annular closing part in addition to the valve seat (7, 8), wherein the valve seat (7, 8) and the closing part are movable in relation to each other and are arranged coaxially to each other.

12. The method according to claim 4, wherein the balloon-type body (4) is collapsed by letting the expansion medium escape from the balloon-type body (4).

13. The method according to claim 5, wherein the at least one fluid path is a gas flow path extending along the balloon-type body (4).

* * * * *